US005356543A

United States Patent [19]

Pugh et al.

[11] Patent Number: 5,356,543

[45] Date of Patent: Oct. 18, 1994

[54] ABRASIVE BELT LIFE BOOSTER

[76] Inventors: Jim Pugh; Raymonde B. Pugh, both of P.O. Box 711, Azle, Tex. 76098

[21] Appl. No.: 11,198

[22] Filed: Jan. 29, 1993

[51] Int. Cl.[5] ..... C10M 105/32

[52] U.S. Cl. ..... 252/11; 252/56 R; 51/295; 51/298; 51/305; 106/231

[58] Field of Search ..... 252/11, 56 R, ; 51/295, 51/298, 305; 106/231

[56] References Cited

U.S. PATENT DOCUMENTS 921,382 5/1909 Elkeles et al. ..... 106/231

4,013,475 3/1977 Liebowitz et al. ..... 106/10

*Primary Examiner*—John Niebling

*Assistant Examiner*—Edna Wong

*Attorney, Agent, or Firm*—Arthur F. Zobal

[57] ABSTRACT

A formulation is provided for application grinding belt of the type having abrasive material secured to a flexible base for extending the useful life of the belt. The formulation is a solution of toluene, naptha, shellac, wax and ethyl alcohol. Methyl salicylate may be included to provide a pleasant odor.

10 Claims, No Drawings

ABRASIVE BELT LIFE BOOSTER

BACKGROUND OF THE INVENTION

1. Field of the Invention

The present invention relates to formulations for extending the useful life of abrasive grinding belts, in particular metal grinding abrasive belts.

2. Description of the Prior Art

Metal grinding is a finishing operation of metal working for providing fine precision finishes, as well as an operation which may be used to remove excess metal as economically and rapidly as possible. Grinding is typically accomplished using an abrasive wheel or an abrasive belt.

Abrasive belts for metal grinding are attached to a belt grinding machine which causes the abrasive belt to rapidly and forcibly contact the metal surface being ground. The abrasive belt has abrasive particles attached thereto which rapidly contact and grind the metal surface. The abrasive particles are attached to the abrasive belt by an adhesive which holds the particles to the belt. As the belt is used the abrasion between the abrasive belt and the metal causes some abrasive particles to work loose of the adhesive and become detached from the belt. The life-span of the belt is determined by how well the abrasive particles are attached to the belt since the belt loses its grinding usefulness after too many particles become detached from the belt. The belt is discarded after losing its usefulness to grind metal.

SUMMARY OF THE INVENTION

It is an object of this invention to provide a formulation or composition to be applied to an abrasive belt that is useful for extending the grinding life of the abrasive belt.

Another object of the invention is to provide a formulation to be applied to an abrasive belt which causes abrasive particles bonded to the abrasive belt to become more firmly bonded to the abrasive belt, thereby extending the useful life of the belt.

A further object of the invention is to provide a formulation to be applied to an abrasive belt which reduces friction between the abrasive belt and a metal surface being ground by the belt, thereby reducing heat generated by abrasion between the belt and the metal.

DESCRIPTION OF THE PREFERRED EMBODIMENTS

The present invention provides a formulation or composition which may be applied to abrasive belts for grinding metal to extend the life of the belts. The formulation is comprised of toluene, naphtha, shellac, a wax, denatured ethyl alcohol, and methyl salicylate mixed together to form a liquid solution. In a preferred embodiment toluene is present in a concentration in a range of 25%–35% by volume of the solution, most desirably 30%; naphtha is present in a concentration in a range of 55%–65% by volume of the solution, most desirably 65%; shellac is present in a concentration in a range of 0.8%–2.5% by volume of the solution, most desirably 1%; wax is present in a concentration in a range of 0.08%–0.14% by volume of the solution, most desirably 0.1%; ethyl alcohol is present in a concentration in a range of 2.4%–7.3% by volume of the solution, most desirably 3%; and methyl salicylate is present in a concentration of 0%–0.11% by volume of the solution, most desirably 0.9%. The preferred ranges of the constituents of the formulation are conveniently summarized in Table 1.

TABLE I

| Constituent of Formulation | Range of Concentrations (% by Volume of Solution) | Preferred Concentration (% by Volume of Solution) |
|---|---|---|
| Toluene | 25–35 | 30 |
| Naphtha | 55–65 | 65 |
| Shellac | 0.8–2.5 | 1 |
| Wax | 0.08–0.14 | 0.1 |
| Ethyl alcohol (denatured) | 2.4–7.3 | 3 |
| Methyl salicylate | 0–0.11 | 0.9 |
| Total | · | 100% |

The formulation acts to increase the bonding of the abrasive particles of the abrasive belt to the belt, and also to reduce the friction between the belt and the metal surface being ground during grinding, thereby reducing the heat produced between the belt and the metal surface. Toluene, naphtha, shellac, and the wax are the constituents of the formulation used to achieve the bonding and heat reducing properties of the formulation. The toluene and naphtha constituents of the formulation soften or liquify the adhesive which holds the abrasive particles to the belt, allowing the formulation to mix with the adhesive on the belt. The toluene and naphtha subsequently evaporate leaving the remaining constituents of the formulation mixed with the adhesive of the belt. The mixture re-adheres the abrasive particles to the belt upon evaporation of the toluene and naphtha. The shellac is an adhesive which cooperates with the adhesive of the belt to provide additional adhesion between the abrasive particles and the belt, causing the abrasive particles to be more firmly bonded to the belt upon evaporation of the toluene and naphtha.

The wax reduces the heat produced between a metal surface and an abrasive belt treated with the formulation during grinding of the metal surface. The wax acts as a lubricant between the abrasive belt and the metal surface, thereby reducing the heat produced by friction between the belt and surface. In the preferred embodiment the wax that is used in the formulation is beeswax, although other waxes, such as microcrystalline wax, may be used.

The remaining constituents of the formulation, alcohol and methyl salicylate, are used to render the shellac soluble in the toluene and naphtha, and to provide a pleasant odor to the formulation. Shellac is insoluble in hydrocarbons such as toluene and naphthas yet is quite soluble in low molecular weight alcohols that are miscible in toluene and naphtha. The alcohol of the formulation is used as a solvent for the shellac so that the shellac may be mixed with the toluene, naphtha, and wax. The alcohol, like the toluene and naphtha, evaporates from the abrasive belt after the formulation is applied to the belt.

Methyl salicylate is artificial wintergreen oil, and has a pleasant odor of wintergreen. Methyl salicylate is added to the formulation to give the formulation a wintergreen odor. The methyl salicylate is used solely to impart odor to the formulation, and may be omitted from the formulation without affecting the bonding and lubricant properties of the formulation.

The relative amounts of the constituents of the formulation are important. Sufficient toluene and naphtha must be present to soften or liquify the adhesive of the abrasive belt, just as sufficient alcohol must be present to render the shellac soluble in the toulene and naphtha. Excessive amounts of toluene, naphtha, and alcohol do not impair functioning of the formulation as the excess toluene, naphtha and alcohol evaporate from the abrasive belt after application of the formulation to the belt. An excessive amount of shellac, however, is undesirable since excessive shellac causes the resulting adhesive on the abrasive belt to be brittle. An insufficient amount of shellac is also undesirable since the bonding provided by the shellac is reduced. An excessive amount of wax is also undesirable since excessive wax inhibits the adhesive bonding of the shellac, abrasive belt adhesive, abrasive particles, and the belt.

Application of the formulation to an abrasive belt is easily accomplished. First, the constituents of the formulation are mixed together in the correct proportions. The formulation is then applied to the belt either by brushing the liquid formulation directly onto the belt, or by placing the formulation in a spray can and spraying the formulation onto the belt. The belt bearing the formulation is allowed to dry for approximately ½ hour. When the belt is dry it is ready for use to grind a suitable metal surface.

The formulation is used to extend the life of metal grinding abrasive belts. The belts are cloth based, the cloth having abrasive particles adhered thereto. Typically, zirconium particles are used as the abrasive media of the belt. The formulation is normally used on zirconium belts having relatively coarse grit particles, i.e. 36–220 micron grit, since coarse grit belts are used for heavy grinding and are more subject to wear than fine grit belts. However, the formulation may be applied to zirconium belts having relatively fine grit particles as well. The treated zirconium belts are especially useful for grinding high carbon stainless steels.

The formulation significantly extends the life of the abrasive grinding belts. Belts treated with the formulation have a useful grinding life between ten and twenty times the grinding life of a similar, untreated belt. For example, a test was performed in which an untreated belt was found capable of sharpening one knife blade per belt, and a belt treated with the formulation was found capable of sharpening eleven knife blades per belt.

The formulation also significantly cools the operating temperature of the belts during grinding. Metal surfaces ground with untreated belts are typically too hot to touch, and must be periodically sprayed with a coolant. Metal surfaces ground with belts treated with the formulation, however, are comparatively cool. The metal surface being ground with the treated belt may be touched, and no coolant is required during the grinding process.

We claim:

1. A formulation for use for application to a grinding belt of the type having abrasive material secured to a flexible base for extending the useful life of the grinding belt comprising a solution of toluene, naphtha, shellac, wax, and ethyl alcohol, wherein:

toluene is present in a concentration in a range of about 25%–35% by volume of the solution;

naphtha is present in a concentration in a range of about 55%–65% by volume of the solution;

shellac is present in a concentration in a range of about 0.8%–2.5% by volume of the solution;

wax is present in a concentration in a range of about 0.08%–0.14% by volume of the solution;

ethyl alcohol is present in a concentration in a range of about 2.4%–7.3% by volume of the solution.

2. A formulation for use for application to a grinding belt of the type having abrasive material secured to a flexible base for extending the useful life of the grinding belt comprising a solution of toluene, naphtha, shellac, wax, and ethyl alcohol, wherein:

toluene is present in a concentration in a range of about 25%–35% by volume of the solution;

naphtha is present in a concentration in a range of about 55%–65% by volume of the solution;

shellac is present in a concentration in a range of about 1.2%–2.5% by volume of the solution;

wax is present in a concentration in a range of about 0.1%–0.15% by volume of the solution;

ethyl alcohol is present in a concentration in a range of about 3.7%–7.3% by volume of the solution.

3. The formulation of claim 2, wherein:

toluene is present in a concentration of 30% by volume of the solution;

naphtha is present in a concentration of 65% by volume of the solution;

shellac is present in a concentration of 1.2% by volume of the solution;

wax is present in a concentration of 0.1% by volume of the solution;

ethyl alcohol is present in a concentration of 3.7% by volume of the solution.

4. The formulation of claim 1 wherein the wax is beeswax.

5. The formulation of claim 2 wherein the wax is beeswax.

6. The formulation of claim 1 further comprising methyl salicylate.

7. The formulation of claim 2 further comprising methyl salicylate wherein methyl salicylate is present in a concentration of 0.07%–0.11% by volume of the solution.

8. The formulation of claim 1, wherein:

toluene is present in a concentration of 30% by volume of the solution;

naphtha is present in a concentration of 65% by volume of the solution;

shellac is present in a concentration of 1% by volume of the solution;

wax is present in a concentration of 0.1% by volume of the solution;

ethyl alcohol is present in a concentration of 3% by volume of the solution;

methyl salicylate is present in a concentration of 0.9% by volume of the solution.

9. The formulation of claim 6 wherein the wax is beeswax.

10. The formulation of claim 7 wherein the wax is beeswax.

* * * * *